US006293215B1

(12) United States Patent
Moorrees

(10) Patent No.: US 6,293,215 B1
(45) Date of Patent: Sep. 25, 2001

(54) SAILING HARNESS

(75) Inventor: Janse van Rensburg Moorrees, Cape Town (ZA)

(73) Assignee: Neil Pryde Limited, Hong Kong (HK)

( * ) Notice: Subject to any disclaimer, the term of this patent is extended or adjusted under 35 U.S.C. 154(b) by 0 days.

(21) Appl. No.: 09/519,911

(22) Filed: Mar. 7, 2000

Related U.S. Application Data

(63) Continuation-in-part of application No. 09/105,422, filed on Jun. 26, 1998, now abandoned.

(30) Foreign Application Priority Data

Jul. 4, 1997 (DE) ..... 297 11 757 U

(51) Int. Cl.[7] ..... B63B 35/85
(52) U.S. Cl. ..... 114/39.18
(58) Field of Search ..... 114/39.16, 39.18; 182/3; 24/164, 191

(56) References Cited

U.S. PATENT DOCUMENTS

| | | | |
|---|---|---|---|
| 4,112,865 | 9/1978 | Carn | 114/39.18 |
| 4,873,934 | 10/1989 | Renault . | |
| 4,934,297 | 6/1990 | Long | 114/39.16 |
| 4,999,846 | 3/1991 | Ball et al. | 24/191 |
| 5,195,443 | 3/1993 | Williams | 114/39.16 |

FOREIGN PATENT DOCUMENTS

| | | | | |
|---|---|---|---|---|
| 3216704A1 | | 11/1983 | (DE) . | |
| 3229147A1 | | 2/1984 | (DE) . | |
| 8404269.9 | | 5/1984 | (DE) . | |
| 34 45 393 | * | 6/1986 | (DE) | 114/39.18 |
| 198 00 757 | * | 9/1999 | (DE) . | |
| 2115684A | | 9/1983 | (GB) . | |

* cited by examiner

*Primary Examiner*—Sherman Basinger
(74) *Attorney, Agent, or Firm*—Jackson Walker L.L.P.

(57) ABSTRACT

A hooked spreader bar is held to a sailor's body by straps at each end. The straps are formed with serrations that are engaged by noses of pivotable locks. When the straps are tight, the locks prevent the straps loosening but provide a quick-release operation when pressed down. The spreader bar is more reliably held to a sailor's body, more simply fitted, and removed. Pivotable locking handles hold respective locks in the closed position.

8 Claims, 3 Drawing Sheets

SAILING HARNESS

This is a continuation-in-part of U.S. patent application Ser. No. 09/105,422, filed Jun. 26, 1998 now abandoned.

BACKGROUND OF THE INVENTION

1. Field of the Invention

The invention relates to sailing harnesses.

2. Description of Prior Art

The invention relates in particular to sailing harness having a hooked spreader bar for attachment to a boom of a windsurfer or a trapeze line of a sail boat rigging. Such an attachment allows the sailor to use his body weight and release his hands for other tasks or simply to relieve, from time to time, the effort required to hold the boom or the trapeze line. Hooked spreader bars are already known and are attachable to a sailor's body harness by webbing straps provided for each end of the spreader bar. Such attachment requires threading of the straps into buckles. This normally takes some time, requires both hands and is not be quickly releasable. Also, inherent loose strap ends can be quite hazardous, especially in high winds where the loose ends flap violently about. Buckled straps tend to loosen in time requiring the sailor to make continuous adjustments in use.

SUMMARY OF THE INVENTION

It is an object of the invention to overcome or at least reduce these problems.

According to the invention there is provided a sailor's support apparatus comprising a hooked spreader bar that fits across the front of a body of a sailor, one or more straps extending to support around the body of the sailor having ends located opposite each respective end of the spreader bar, and quick release locking means mounted to the spreader bar arranged to hold the strap tight and securely adjacent each respective end of the spreader bar.

The support apparatus may include a harness and the straps comprise two straps that are each anchored at one end to the harness.

Ends of the straps may have serrated surfaces, pivotable stops being mounted to the spreader bar adjacent respective ends to lock against selected of the serrations when the straps are tight to form the quick-release locking means.

The pivotable stops may be spring biassed towards the serrated surface of the strap.

Locking handles may be provided and arranged to hold the locking means closed.

BRIEF DESCRIPTION OF THE DRAWINGS

A sailor's support apparatus according to the invention will now be described by way of example with reference to the accompanying drawings in which.

DESCRIPTION OF THE PREFERRED EMBODIMENTS

Figure 1:
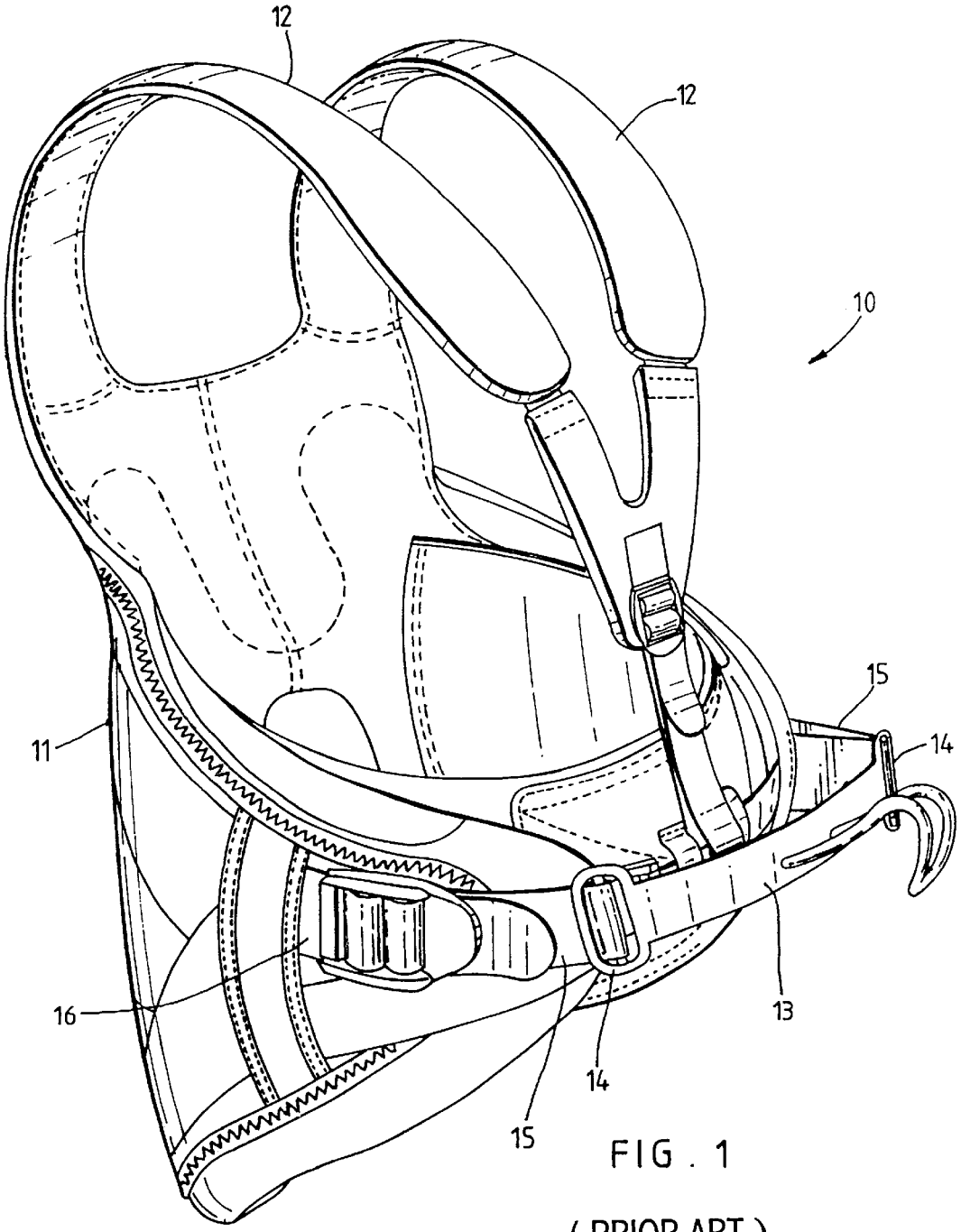
FIG. 1 ( PRIOR ART )
FIG. 1 is an isometric view of a prior art apparatus.

Referring to the drawings, in FIG. 1 support apparatus comprises a comprehensive harness 10 which in use adjustably fits to a sailor's upper torso having a back support 11 and shoulder straps 12. A hooked spreader bar 13 has a buckle 14 at each end and is provided with straps 15 that are buckled to straps 16 that are anchored to the harness 10. The spreader bar 13 is attached after the harness is fitted to the sailor by threading and tightening the straps 15 in conventional manner.

Figure 2:
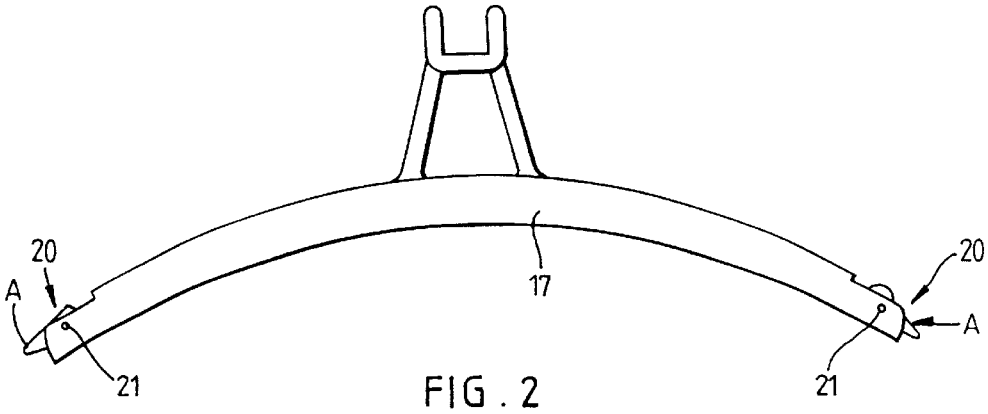
FIG. 2 is a side view of a spreader bar for use in an apparatus of the present invention.
Figure 3:
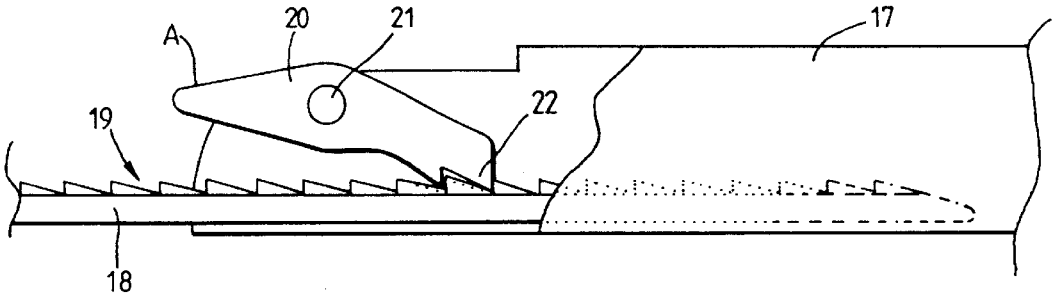
FIG. 3 is an enlarged diagrammatic part cut-away view of part of the apparatus of the present invention.

In FIGS. 2 and 3, a hooked spreader bar 17 is formed of a hollow curved tube having a cross-section that is generally circular at its centre and rectangular at each end where it is dimensioned to receive ends of straps 18, only one strap is shown (in FIG. 3). The straps 18 have widths that fit snugly into the rectangular sectioned ends of the spreader bar 17. The outer (or upper, as seen in FIG. 3) surfaces of the straps 18 are formed with serrations 19 and a pivotable lock 20 is mounted at each end of the spreader bar 17 on axles 21 supported in opposing sides of the spreader bar. Each lock 20 has a shaped nose 22 that fits snugly against the serrations, as shown in FIG. 3. One end of each strap 18 is anchored to a suitable harness, such as shown in FIG. 1 normally to comprise straps equivalent to straps 15 but in this case preferably fixed directly to the harness.

The spreader bar 17 is fitted by pushing the ends of the straps 18 into respective ends of the spreader bar 17 until the spreader bar 17 is held against the sailor's body. At this point, each lock 20 will have entered and be pressed against an appropriate respective serration of the straps 18. The straps will then be held firmly thereafter and will need no further adjustment. Due to the pivoting action of the locks 20, the more tension that is applied to the straps 18, the more firmly will the locks hold the straps in a chosen or selected relative positions inside the spreader bar. However, if the sailor wishes to loosen or remove the straps 18 from the spreader bar 17, the lock 20 can be released by pressing down at A on the locks 20 to pivot the noses 22 away and quickly out of engagement with the serrations 19.

The locks 20 may be spring biassed, if preferred, towards the serrated surface of the straps 18.

Figure 4:
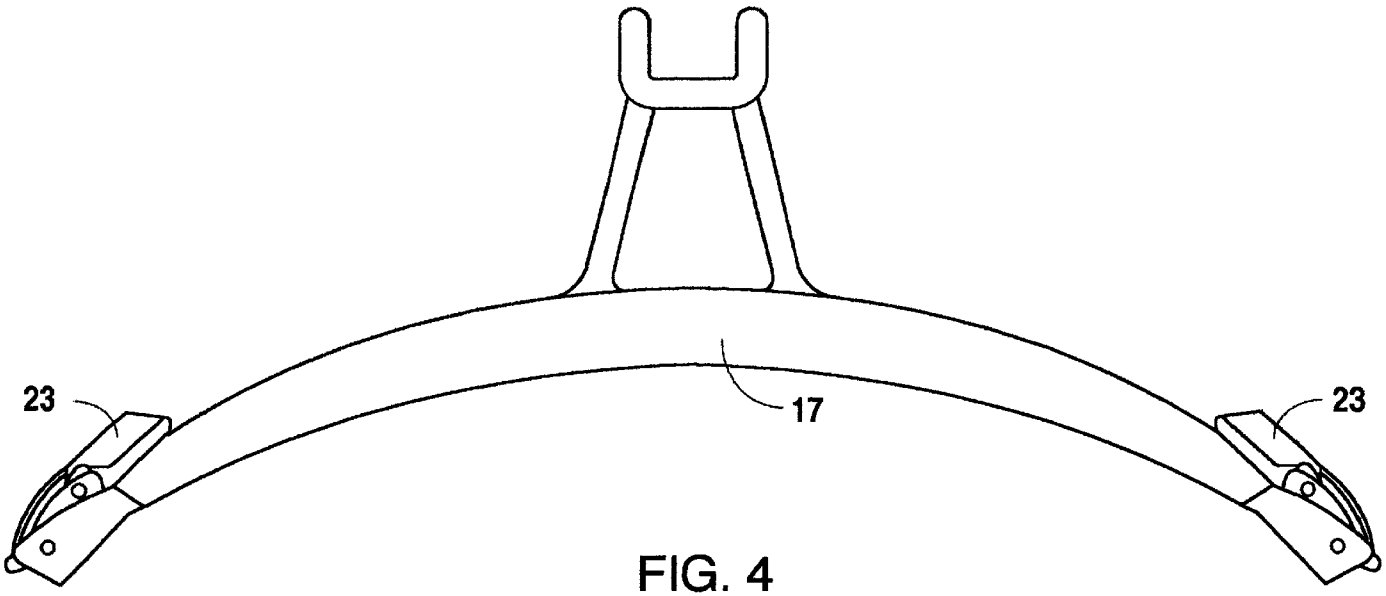
FIG. 4 is a side view of the spreader bar having additional locking handles.
Figure 6:
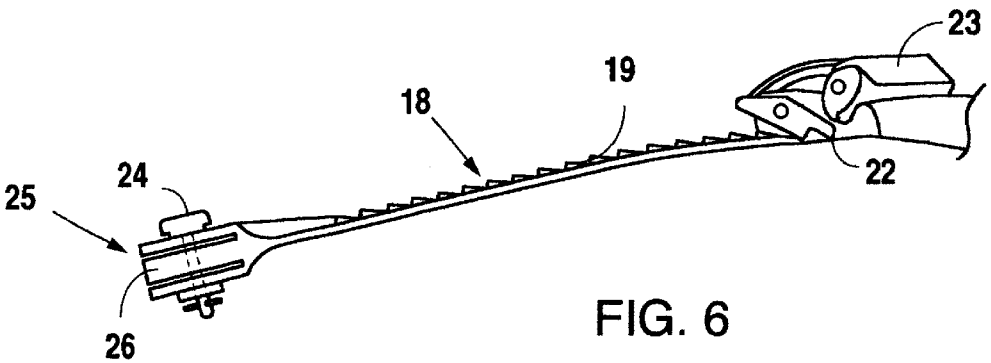
FIG. 6 shows the additional locking handle in another position.
Figure 5:
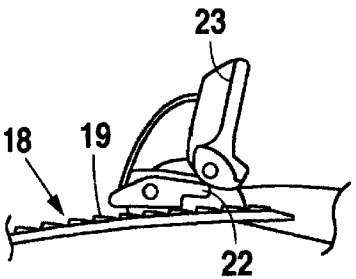
FIG. 5 shows the additional locking handle in one position.

In FIGS. 4 to 6, additional locking handles 23 are shown. The locking handles 23 comprise over-centre toggles that can close against respective locks 20. The additional lock is "open" in FIG. 5 and "closed" in FIG. 6. Thus, in order to release or to facilitate fitting and tightening the straps 18, the locking handle 23 must be in the position shown in FIG. 5. Once the strap 18 has been fitted and tightened, the locking handle is closed against the lock 20, as shown in FIG. 6. When the handle 23 is closed, the handle prevents the nose 22 lifting up sufficiently, away from the serrations 19, to release a locking action of the nose 22 against the serrations. It will be clear that without the provision of the handles 23 the straps 18 might loosen (i.e. the nose 22 may slip over serrations 19) when tension in a strap is temporarily eased or removed. As a result, the straps 18 could become slack or totally disengaged from the spreader bar 17 in use. In reality however, the main practical function of the locking handles 23 is to prevent the straps becoming too tight. In other words, there can be a tendency for the straps to tighten during use in moments when the tension in the straps eases and ends of the strap 18 slip further towards the centre of the spreader bar. Thus, the main function of the locking handles 23 is to prevent inadvertent over-tightening of the straps 18 in use.

The straps 18 are each preferably fitted to anchor straps or directly to the harness 10 using a stud 24 (see FIG. 6). An anchor end 25 of the strap 18 is integrally formed with an anchor body 26 through which the stud 24 slidingly fits. This allows a certain amount of useful pivotable movement between the anchor body 26 and the harness 10. Also, this provision allows the strap 18 to be readily removed and replaced when required, due to normal wear-and-tear or failure. Such removal and replacement can be carried out by the user of the harness and, if necessary, without removing the harness 10 from his body.

It will be appreciated that other forms of quick release locking means may be used to lock the straps required distances inside the ends of the spreader bar, including a manually operable clamp or brake arrangement. Further, and because the hollow spreader bar allows, in general terms, a large measure of adjustment (the straps and spreader may be configured to allow the ends of straps 18 to enter far into the inside of the spreader bar), the straps 18 may be formed by a single length of suitable material that extends around the body of the sailor in use to provide at each of its ends both the straps 18. In this way or otherwise, the simplest apparatus provided by the invention may comprise only a single strap and the spreader bar. Normally, the apparatus of the invention will include a harness but could be simply the described spreader bar with quick-release locking means at each end and a single strap, or simple harness, which is attachable or held to say a life jacket for example.

I claim:

1. A sailor's support apparatus comprising:

a hooked spreader bar that fits across the front of a body of a sailor;

at least one strap extending to support around said body of said sailor said strap having ends located opposite each respective end of said spreader bar;

quick release locking means mounted to said spreader bar arranged to hold said at least one strap tightly and securely adjacent each respective end of said spreader bar, said quick release locking means having a pivotable release member mounted by an axle directly to said spreader bar.

2. A sailor's support apparatus comprising:

a hooked spreader bar that fits across the front of a body of a sailor;

at least one strap extending to support around said body of said sailor said strap having ends located opposite each respective end of said spreader bar;

quick release locking means mounted to said spreader bar arranged to hold said strap tightly and securely adjacent each respective end of said spreader bar; and a pivotable locking handle to hold a respective locking means closed.

3. The sailor's support apparatus according to claim 1, further comprising a harness in which said at least one strap comprises two straps each anchored at one end to said harness.

4. The sailor's support apparatus according to claim 1, wherein said ends of said at least one strap have serrated surfaces and pivotable stops mounted to said spreader bar adjacent respective ends to lock against selected said serrations when said at least one strap is tight to form said quick-release locking means.

5. The sailor's support according to claim 4, wherein said pivotable stops are spring biased towards said serrated surface of said at least one strap.

6. The sailor's support apparatus according to claim 2, further comprising a harness in which said at least one strap comprises two straps each anchored at one end to said harness.

7. The sailor's support apparatus according to claim 2, wherein said ends of said at least one strap have serrated surfaces and pivotable stops mounted to said spreader bar adjacent respective ends to lock against selected said serrations when said at least one strap is tight to form said quick-release locking means.

8. The sailor's support according to claim 7, wherein said pivotable stops are spring biased towards said serrated surface of said at least one strap.

* * * * *